US006019846A

United States Patent [19]

Graf et al.

[11] Patent Number: 6,019,846

[45] Date of Patent: Feb. 1, 2000

[54] COATER ROD BED

[75] Inventors: Edwin X. Graf, Menasha; Wayne T. Hatton, Little Chute, both of Wis.

[73] Assignee: Voith Sulzer Paper Technology North America, Inc., Appleton, Wis.

[21] Appl. No.: 08/991,081

[22] Filed: Dec. 16, 1997

[51] Int. Cl.[7] ..... B05C 3/02

[52] U.S. Cl. ..... 118/414; 118/117; 118/262

[58] Field of Search ..... 118/116, 414, 118/118, 126, 262, 261; 15/256.52, 256.5; 101/169

[56] References Cited

U.S. PATENT DOCUMENTS

| | | | |
|---|---|---|---|
| 3,559,572 | 2/1971 | Hackley | 118/118 |
| 4,847,135 | 7/1989 | Braus et al. | 384/911 |
| 5,134,958 | 8/1992 | Zimmer | 118/126 |
| 5,383,968 | 1/1995 | Rantanen et al. | 118/118 |
| 5,433,781 | 7/1995 | Bernert | 118/118 |
| 5,599,392 | 2/1997 | Liang et al. | 118/126 |

*Primary Examiner*—Brenda A. Lamb
*Attorney, Agent, or Firm*—Taylor & Associates, P.C.

[57] ABSTRACT

A coater for directly or indirectly applying a coating medium to a fiber web includes a mounting; a coater rod; and a coater rod bed connected to the mounting. The coater rod bed includes a metal body with a longitudinal extension, a rod holding portion with an inner contoured surface, at least one longitudinally extending groove in the contoured surface, and at least one non-metallic bearing strip within each respective longitudinally extending groove. The coater rod bed is rotatably carried within the rod holding portion and directly engaged by each non-metallic bearing strip.

14 Claims, 2 Drawing Sheets

COATER ROD BED

BACKGROUND OF THE INVENTION

1. Field of the Invention

The present invention relates to a machine for applying a coating medium to a moving surface (e.g., a fiber material web, applicator roll or backing roll), and, more particularly, to a machine for applying a coating mixture to a moving surface using a coater rod.

2. Description of the Related Art

A machine for applying a liquid or viscid medium (such as sizing) to a moving surface may include a coater rod which is positioned closely adjacent to the moving surface. The distance between the coater rod and the moving surface during operation determines the thickness of the coating which is applied to the moving surface. Typically, the coater rod is connected to a beam or mounting via a coater rod bed and a blade. The blade is flexible and allows the coater rod to be moved toward and away from the moving surface using known adjustment devices, such as profile adjusting screws and a load tube. The coater rod bed is conventionally manufactured from a polyurethane material, such as those having a polyether or polyester base. Such materials include the physical property of being relatively resilient. The coater rod bed can therefore be constructed to clampingly engage each of the blade and the coater rod.

A problem with a conventional coater rod bed constructed of polyurethane is that such a material deteriorates when exposed to the operating environment of a coating machine. More particularly, polyurethane is susceptible to flaking and other permanent deterioration upon exposure to water, NaOH, and other solvents. A coater rod bed constructed of polyurethane must therefore be replaced from time-to-time because of such physical or chemical deterioration.

Another problem associated with using a coater rod bed constructed of polyurethane is that such a material is susceptible to swelling in the operating environment of a coating machine. The term "swelling", as used in this application, refers to chemically induced swelling of the coater rod bed caused by the exposure in the operating environment of the coating machine. The coater rod bed does not quickly return to its normal state upon occurrence of such chemically induced swelling. Such swelling may cause the coater rod bed to go out of dimensional tolerances, and further may result in an excessive, binding fit between the coater rod bed and the blade and/or coater rod.

Yet another problem with using a coater rod bed constructed of polyurethane is that such a material may not be capable of supporting a larger diameter coater rod during use. That is, a larger diameter coating rod has a correspondingly heavier weight which must be supported by the coater rod bed. A large diameter coater rod may exert sufficient loading on a polyurethane coater rod bed caused by gravitational force to physically deform the lip of the coater rod bed, which in turn may allow the coater rod to disengage from the coater rod bed. Alternatively, the heavy weight of a larger diameter coater rod may cause accelerated wear to the coater rod bed, which in turn results in more frequent and thus more costly repair and/or replacement.

What is needed in the art is a coating machine having a coater rod bed which is not susceptible to undue physical deformation and/or wear when carrying a larger diameter and thus heavier coater rod.

SUMMARY OF THE INVENTION

The present invention provides a coating machine with a coater rod bed for holding a coater rod, wherein the coater rod bed is constructed of titanium with a plurality of non-metallic, low friction wear strips which directly engage and carry the coater rod in a rod holding portion.

The invention comprises, in one form thereof, a coater for directly or indirectly applying a coating medium to a fiber web. The coater includes a mounting; a coater rod; and a coater rod bed connected to the mounting. The coater rod bed includes a metal body with a longitudinal extension, a rod holding portion with an inner contoured surface, at least one longitudinally extending groove in the contoured surface, and at least one non-metallic bearing strip within each respective longitudinally extending groove. The coater rod bed is rotatably carried within the rod holding portion and directly engaged by each non-metallic bearing strip.

An advantage of the present invention is that the coater rod bed is constructed of metal, preferably titanium, including a plurality of wear strips which are relatively low friction and may be replaced without replacing the entire coater rod bed.

Another advantage is that relatively large diameter coater rods with a corresponding relatively heavy weight can be carried by the metal coater rod bed without accelerated wear to the coater rod bed.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

The exemplification set out herein illustrates one preferred embodiment of the invention, in one form, and such exemplification is not to be construed as limiting the scope of the invention in any manner.

DETAILED DESCRIPTION OF THE INVENTION

Figure 1:
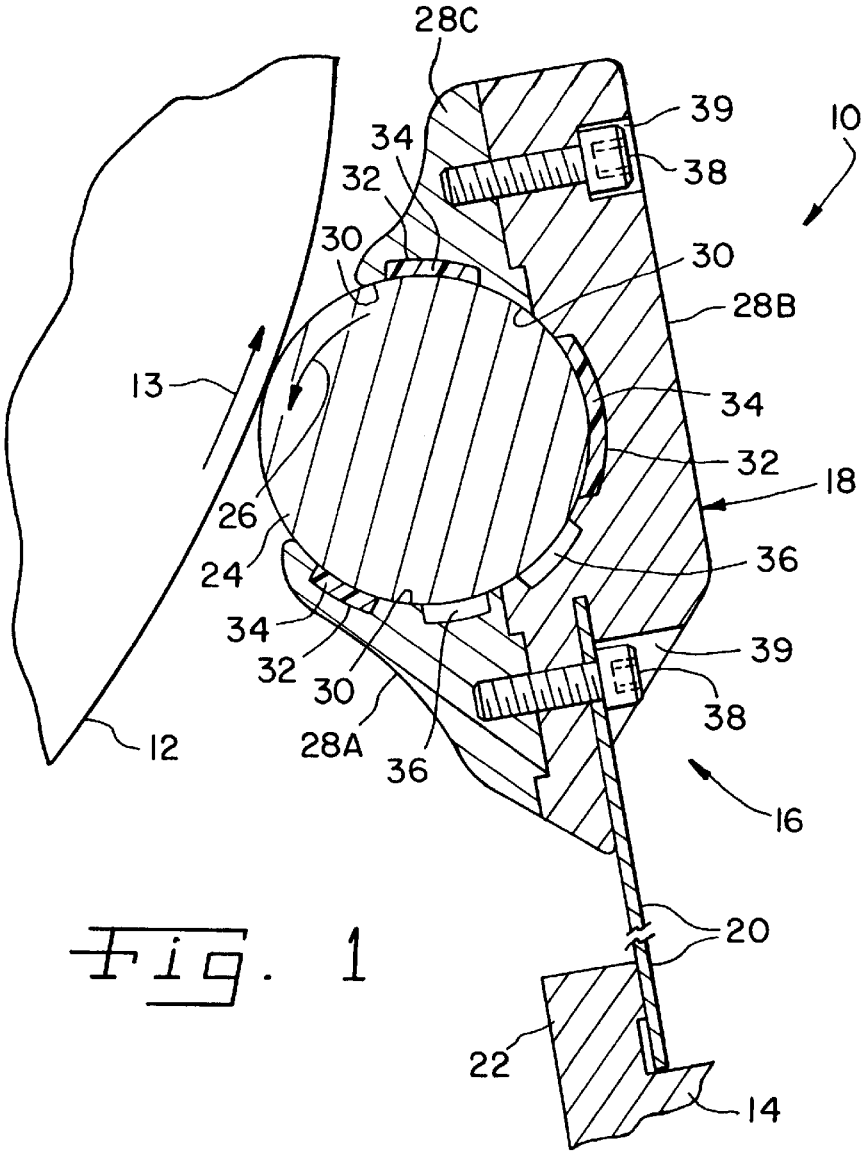
FIG. 1 is a fragmentary, side view of a coater assembly, including an embodiment of a coater rod bed of the present invention.
Figure 3:
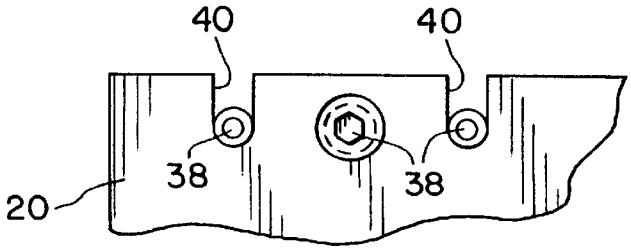
FIG. 3 is a fragmentary, plan view illustrating interconnection between the coater rod bed and blade of FIGS. 1 and 2.
Figure 2:
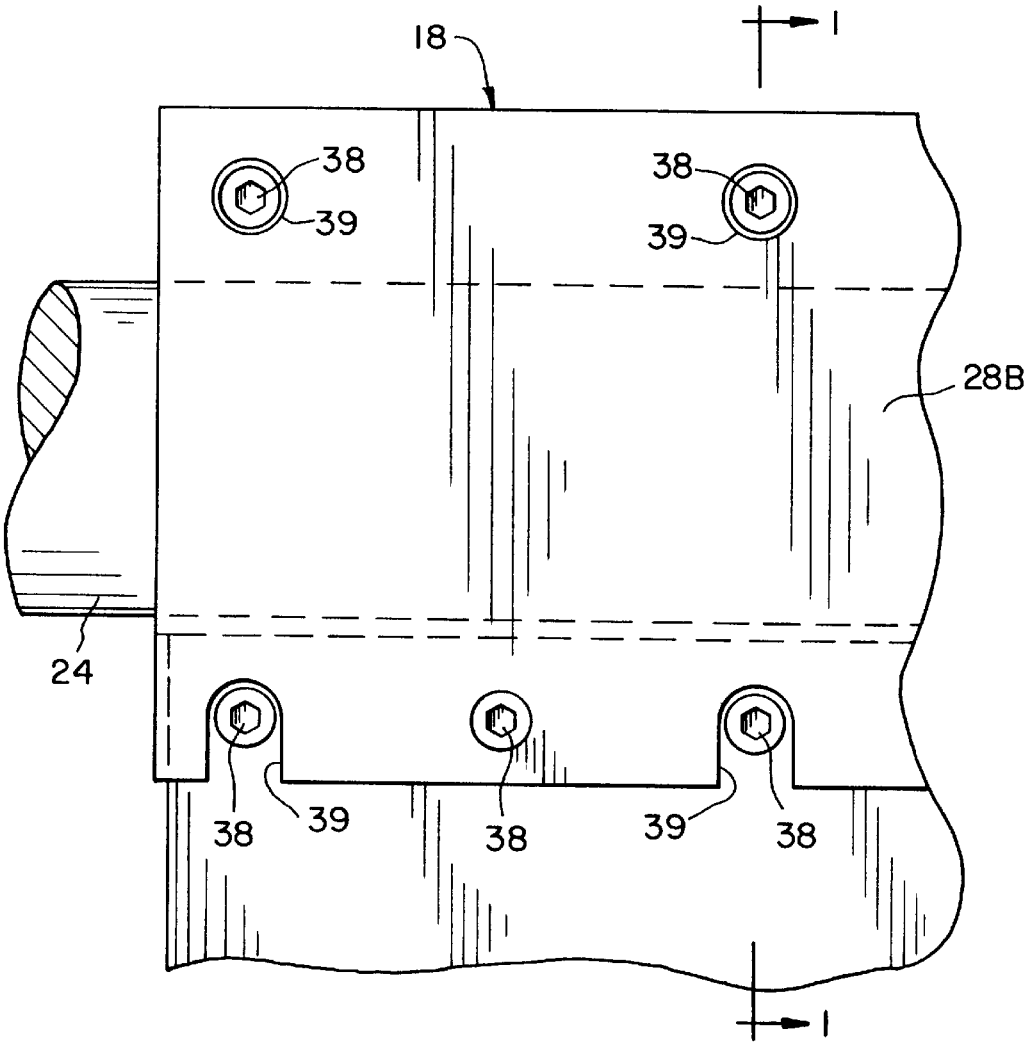
FIG. 2 is a fragmentary, rear view of the coater rod bed of FIG. 1, as viewed from the right of FIG. 1.

Referring now to the drawings, and more particularly to FIG. 1, there as shown an embodiment of a machine in the form of a coater 10 for applying a coating medium (not shown) to a moving surface 12. Coater 10 generally includes a beam or mounting 14 and a coater rod assembly 16.

Moving surface 12, in the embodiment shown, is in the form of an applicator roll 12 which rotates in the direction of arrow 13. When configured as such, it is thus apparent to those skilled in the art that coater 10 applies the coating medium (such as sizing) on a material web (such as paper or cardboard) in an indirect manner via an intermediate application of the coating medium on applicator roll 12. Moving surface 12 may also be in the form of a backing roll or a fiber web. If moving surface 12 is in the form of a fiber web, it will be appreciated by those skilled in the art that coater 10 carries out a direct application of the coating medium on moving surface 12.

Coater rod assembly 16 includes a coater rod bed 18 which is interconnected with mounting 14 via an elastic support element in the form of a blade 20. More particularly, blade 20 is clamped near one end thereof against a blade support bar 22 of mounting 14 using a blade clamping air tube (not shown) which biases blade 20 toward blade support bar 22. Blade 20 may be clamped or otherwise attached to mounting 14 using other suitable devices or techniques. An opposing end of blade 32 is received within and attached to coater rod bed 18.

Coater rod assembly 16 also includes a coater rod 24 which is disposed within and carried by coater rod bed 18. In the embodiment shown in FIG. 1, coater rod 24 has a substantially circular cross-section and is disposed adjacent to moving surface 12. Coater rod 24 extends in a direction corresponding to the width of moving surface 12 (i.e., generally perpendicular to the drawing page of FIG. 1) and is driven in a rotational direction by a driver (not shown), as indicated by arrow 26. Coater rod 24 appears to be in direct contact with moving surface 12 in FIG. 1; however, it will be appreciated that during operation a small gap likely exist between coater rod 24 and moving surface 12.

According to the present invention, coater rod bed 18 is constructed as a metallic rod bed from, e.g., titanium or aluminum. More particularly, coater rod bed 18 includes three longitudinally extending, interconnected body pieces 28A, 28B and 28C which conjunctively define a rod holding portion with an inner contoured surface 30. In the embodiment shown, contoured surface 30 has a shape which is approximately the same as the peripheral shape of coater rod 24. Contoured surface 30 includes at least one longitudinally extending groove 32 therein, in which is respectively disposed at least one non-metallic bearing strip 34. In the embodiment of FIG. 1, inner contoured surface 30 includes three longitudinally extending grooves 32 which are formed in the portions of the contoured surface 30 which are respectively defined by metallic body pieces 28A, 28B and 28C. Coater rod 24 is directly engaged by each non-metallic bearing strip 34.

Non-metallic bearing strips 34 are constructed from a non-metallic material having a coefficient of friction which is less than a coefficient of friction of metal bodies 28A, 28B and 28C. In the embodiment shown, bearing strips 34 are constructed from polytetrafluoroethylene (PTFE) or RULON (TM). PTFE has a relatively low coefficient of friction and thereby prevents wear to coater rod 24. The PTFE may be reinforced to enhance the wear characteristics thereof, while at the same time not substantially affecting the wear rate of coater rod 24. For example, the PTFE from which bearing strips 34 are constructed may be reinforced with oriented or randomly oriented reinforcing fibers such as fiberglass, carbon fibers, etc.

Since coater rod bed 18 is constructed from a metal, rather than a somewhat deformable, non-metallic material, coater rod bed 18 is formed in multiple body pieces 28A, 28B and 28C to allow at least one of the body pieces 28A–28C to be removed and thereby install or remove coater rod 24. Body pieces 28A–28C are connected to each other in any suitable manner, such as by using fasteners in the form of bolts 38. Bolts 38 are disposed within recesses 39 in body piece 28B such that the heads of bolts 38 do not extend from body piece 28B to an appreciable extent. The interfacing surfaces between body pieces 28A–28C may also be provided with stepped or keying surfaces (shown but not numbered) for ensuring proper alignment between body pieces 28A–28C. Rather than being constructed from three body pieces as shown, coater rod bed 18 may also be constructed from a different number of body pieces, such as two or four body pieces.

Coater rod bed 18 may also be constructed with one or more fluid channels 36 in contoured surface 30 through which a fluid may flow to provide cooling, cleaning and/or lubrication of coater rod 24.

By constructing coater rod bed 18 from a metallic material, rather than a non-metallic material as is conventionally known, a relatively large diameter coater rod 24 with a resultant large weight may be carried by coater rod bed 18 without undue stress and deformation thereof. Non-metallic bearing strips 34 further assist in preventing wear between coater rod bed 18 and coater rod 24 which would otherwise occur as a result of metal-to-metal contact. Bearing strips 34 thus maintain a slight clearance distance between metallic coater rod bed 18 and metallic coater rod 24 to improve the wear properties of each.

Blade 20 is formed with a plurality of cut-outs 40 which allow blade 20 to be removed from coater rod bed 18 without entirely disassembling body pieces 28A and 28B. To wit, blade 20 includes a cut-out 40 associated with every other bolt 38 in body piece 28B. The bolts associated with cut-outs 40 may be loosened but not entirely removed from body piece 28A; while the bolts not associated with cut-outs 40 are removed from each of body pieces 28A and 28B. After loosening the bolts 38 associated with cut-outs 40 and removing the remaining bolts, blade 20 may be simply slid away from body piece 28B to disengage blade 20 therefrom.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A machine for directly or indirectly applying a coating medium to a fiber material web, comprising:

a mounting;

a coater rod bed connected to said mounting, said coater rod bed including three detachably interconnected metal body pieces, each said metal body piece having a longitudinal extension, said three metal body pieces conjunctively defining a rod holding portion with an inner contoured surface, at least three longitudinally extending grooves in said contoured surface each of said three metal body pieces having at least a respective one of said at least three longitudinally extending grooves;

at least three non-metallic bearing strips, each said non-metallic bearing strip being disposed within a respective said longitudinally extending groove, each said bearing strip being structured and arranged to be insertable and removable within a respective said longitudinally extending groove in a direction orthogonal to said respective longitudinally extending groove and said longitudinal extension; and a coater rod for applying the coating medium on a moving surface, the moving surface is one of an applicator roll for applying the coating medium onto the fiber material web and the fiber material web, the coater rod carried within said rod holding portion and directly engaged by each said non-metallic bearing strip.

2. The machine of claim 1, wherein said metal body is comprised of one of titanium and aluminum.

3. The machine of claim 2, wherein said metal body consists essentially of titanium.

4. The machine of claim 1, wherein each said non-metallic bearing strip is comprised of polytetrafluoroethylene.

5. The machine of claim 4, wherein said non-metallic bearing strip includes reinforcing fibers.

6. The machine of claim 5, wherein said reinforcing fibers comprise one of fiberglass and carbon fiber.

7. The machine of claim 6, wherein each said non-metallic bearing strip is comprised of polytetrafluoroethylene with approximately five (5) percent of said one of fiberglass and carbon fiber by volume.

8. The machine of claim 1, wherein each said non-metallic bearing strip has a coefficient of friction which is less than a coefficient of friction of said metal body.

9. The machine of claim 1, wherein each said non-metallic bearing strip has a coefficient of friction which is less than a coefficient of friction of said coater rod.

10. The machine of claim 1, wherein said three detachably interconnected metal body pieces of said coater rod bed are disposed substantially parallel to each other such that said coater rod bed has a subdivided cross-sectional profile.

11. The machine of claim 1, further comprising a blade interconnecting said coater rod bed with said mounting, said blade including at least one cut-out.

12. The machine of claim 1, wherein said coater rod is comprised of metal.

13. The machine of claim 1, wherein said coater rod has a substantially circular cross-section.

14. The machine of claim 1, wherein each said detachably interconnected metal body piece includes at least one interfacing surface, each said interfacing surface being configured for interfacing with another said interfacing surface of an other said metal body piece, each said interfacing surface having at least one of a stepped surface and a keying surface.

* * * * *